United States Patent [19]

Ago

[11] 4,266,455

[45] May 12, 1981

[54] LONG-SIZED WIRE TRANSFER APPARATUS

[75] Inventor: Hitoshi Ago, Kawanishi, Japan

[73] Assignee: Shin Meiwa Industry Co., Ltd., Hyogo, Japan

[21] Appl. No.: 117,101

[22] Filed: Jan. 31, 1980

[30] Foreign Application Priority Data

Feb. 8, 1979 [JP] Japan ..... 54-14016

[51] Int. Cl.[3] ..... B21F 11/00; B21F 23/00

[52] U.S. Cl. ..... 83/84; 83/151; 83/155.1; 83/158; 81/9.51; 140/140; 198/457

[58] Field of Search ..... 83/84, 155.1, 151, 158, 83/159, 160; 81/9.51; 140/140; 198/434, 456, 457

[56] References Cited

U.S. PATENT DOCUMENTS 3,653,412 4/1972 Gudmestad ..... 81/9.51 X 3,927,590 12/1975 Gudmestad ..... 83/151

4,156,961 5/1979 Agoh ..... 81/9.51 X

*Primary Examiner*—J. M. Meister

*Attorney, Agent, or Firm*—W. G. Fasse; D. F. Gould

[57] ABSTRACT

A long-sized wire transfer apparatus for use with a wire cutting machine or the like including a wire feed mechanism and a cutter blade assembly which opens and closes to cut into predetermined lengths a wire intermittently fed in by the wire feed mechanism. The wire transfer apparatus comprises a wire clamping transfer conveyor laterally extending from the downstream side of the cutter blade assembly in a direction at the right angles to the wire withdrawing line, a wire drift conveyor composed of an endless belt extending laterally from the initial end of the transfer conveyor through a slide plate of suitable length along the wire withdrawing line, and a wire collecting device or the like disposed immediately below the terminal end of the wire clamping transfer conveyor.

21 Claims, 13 Drawing Figures

LONG-SIZED WIRE TRANSFER APPARATUS

BACKGROUND OF THE INVENTION

1. Field of the Invention

The present invention relates to a long-sized wire supporting apparatus, and more particularly to such apparatus for use with wire cutting machines, for example.

2. Description of the Prior Art

The applicant has previously developed a long-sized wire collecting apparatus for use with an automatic insulated wire cutting and insulation stripping machine (usually referred to as a wire stripper), as disclosed in U.S. Pat. No. 4,156,961, which comprises cutter assemblies opposed to each other and each having wire cutters and an insulation cutter disposed between said wire cutters, and a wire withdrawing and insulation extracting movable clamp device, said wire collecting apparatus comprising a first wire storing device disposed immediately below the path of movement of said movable clamp device and having a wire correcting guide and a bottom which can be opened and closed, said first wire storing device being adapted to be opened and closed somewhat later than the opening of said cutter assemblies after the wire cutting operation of the latter, a second wire storing device having an openable and closable bottom and having a capacity of accommodating an amount of cut wire lengths corresponding to a number of times of cutting, said second wire storing device being adapted to be opened and closed or closed and opened at every predetermined number of times of cutting, and a wire collecting tray disposed immediately below said second wire storing device and capable of accommodating a predetermined number of cut wire lengths.

However, in said long-sized wire collecting apparatus, since the wire withdrawn moves slidingly on the bottom of the first wire storing device, in the case of wires for wiring for automobiles or electric appliances, a length of 1.5m is the maximum despite the term "long-sized" since a longer wire would produce a greater slide friction, causing the bending of the wire and making the travel of the wire difficult.

SUMMARY OF THE INVENTION

In view of the above, the present invention provides a long-sized wire transfer apparatus for use with a wire cutting machine or the like. In the wire cutting machine, a wire intermittently withdrawn by a wire feed mechanism including a wire clamp device and wire feed rollers is cut into predetermined lengths by the opening or closing action of a cutter blade assembly at least having a pair of opposed wire blades, for example.

The present long-sized wire transfer apparatus is characterized in that it comprises a wire clamping transfer conveyor extending laterally from the downstream side of said cutter blade assembly, for example, in a direction at the right angles to the wire withdrawing direction, and a wire drift conveyor comprising an endless conveyor belt, for example, extending laterally from the initial end of said wire clamping transfer conveyor, preferably, via a slide plate of suitable length in the wire withdrawing direction.

In a preferred embodiment of the present invention, said wire clamping transfer conveyor is intermittently operated such that it starts driving somewhat later than the cutting of the withdrawn wire and stops a little short of the transfer end for the transferred wire, said wire drift conveyor being intermittently operated such that it starts driving somewhat later than the wire withdrawal and stops simultaneously with the completion of the wire movement, whereby a long-sized wire, while being maintained in the straightened state, can be delivered to the next process, such as at a wire receiving section, at the transfer end in the right angle direction after cutting.

DESCRIPTION OF THE PREFERRED EMBODIMENTS

Figure 1:
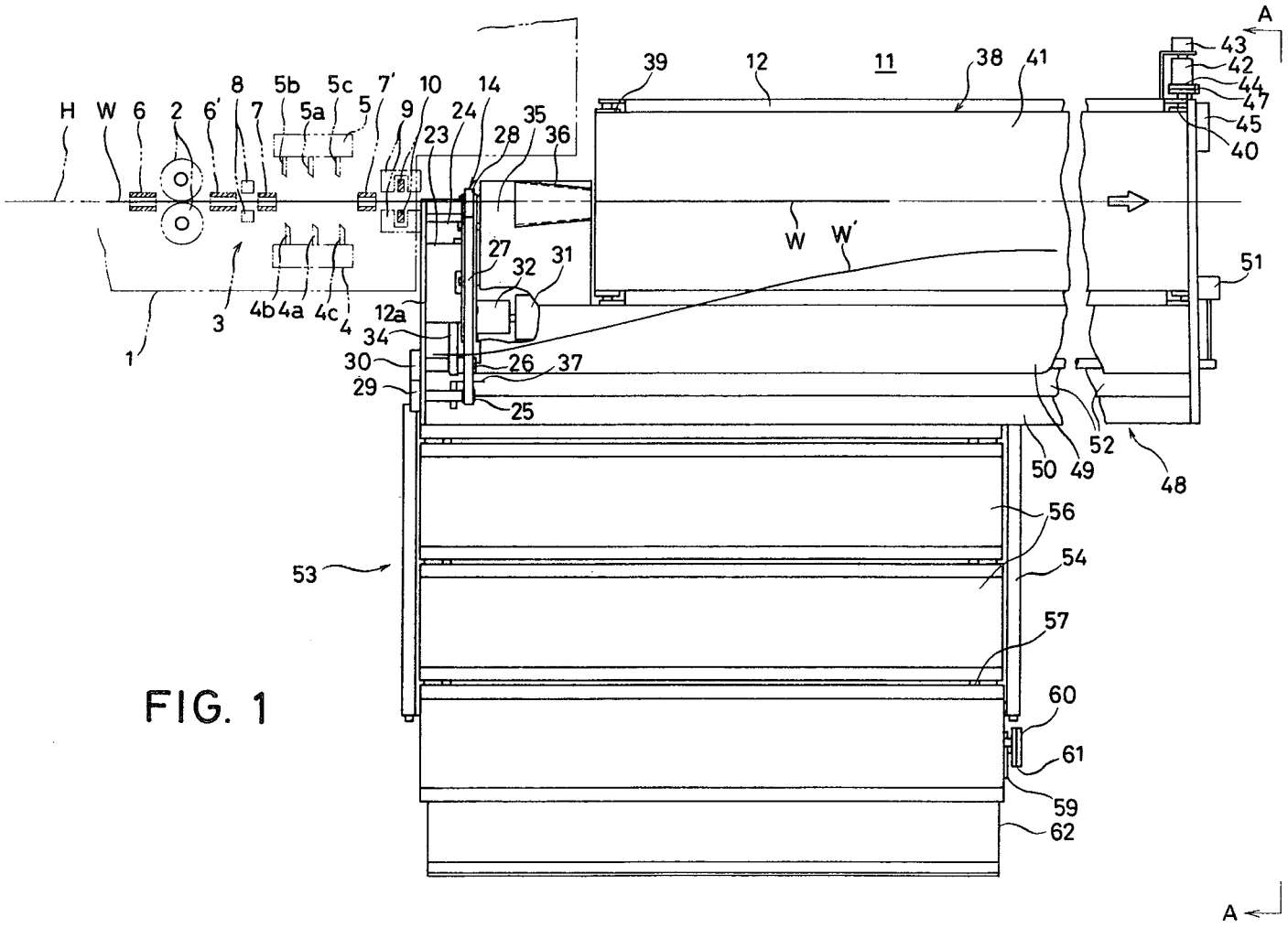
FIG. 1 is a top plan view of an apparatus embodying the present invention.
Figure 2:
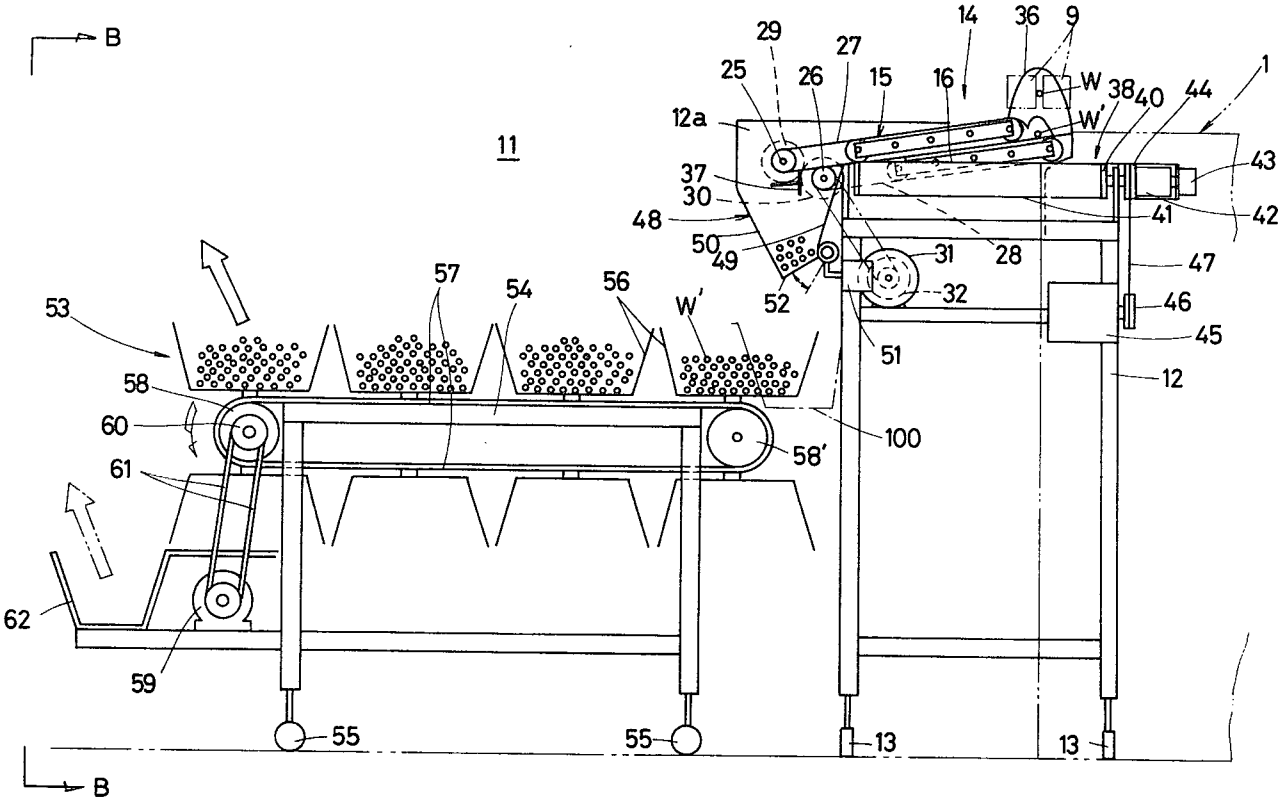
FIG. 2 is a side view taken in the direction of the arrows A—A of FIG. 1.
Figure 3:
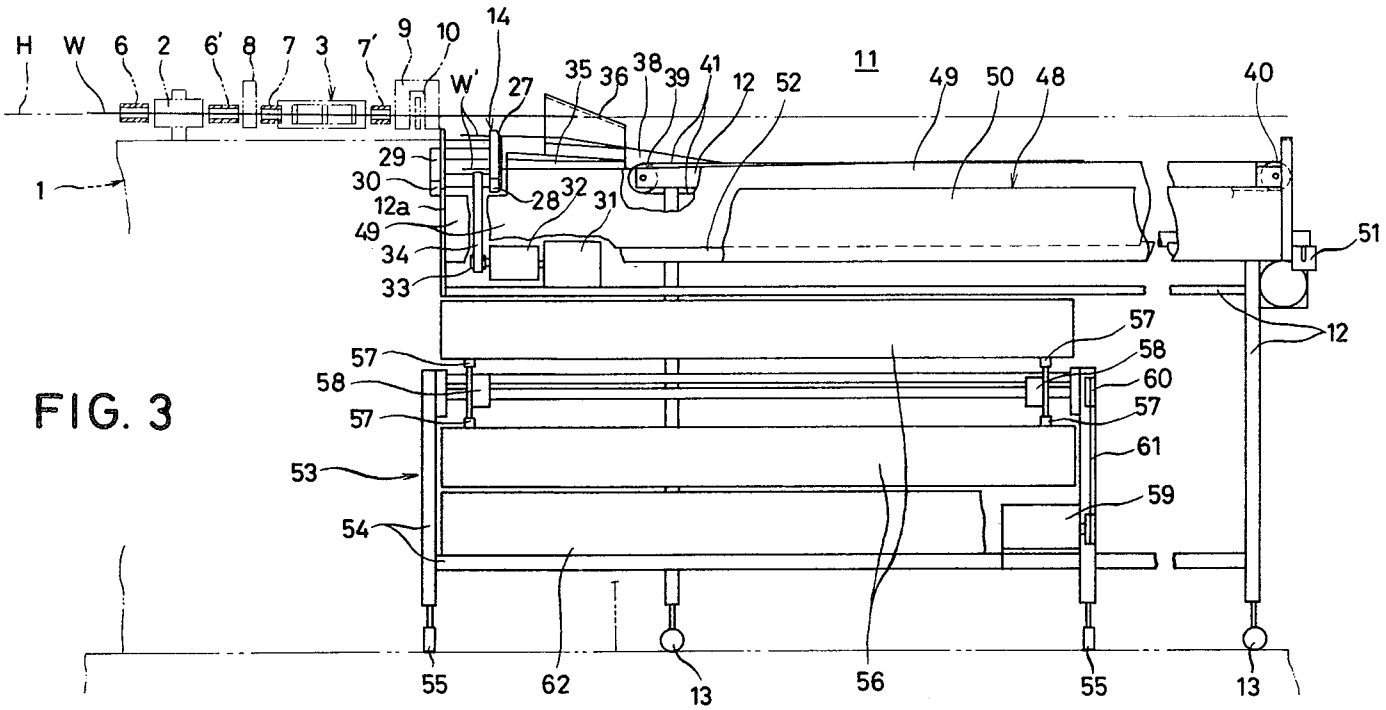
FIG. 3 is a side view taken in the direction of the arrows B—B of FIG. 2.

Referring to FIGS. 1 through 3, prior to describing illustrated embodiments, the cutting and insulation stripping device of a known wire stripper 1 related to the present invention will be described. In addition, for the convenience of description, the left and right in FIGS. 1 and 2 will be referred to as the left (side) or upstream side and the right (side) or downstream side, and in FIG. 3, the left and right will be referred to as the front (region or side) and the rear (region or side).

The numeral 2 denotes a pair of wire feed rollers adapted to be intermittently driven to withdraw a wire W in successive required amounts from an unillustrated wire stock reel to feed said wire to a cutter blade assembly 3 disposed on the downstream side. The cutter blade assembly 3 comprises a front cutter head 4 and a rear cutter head 5 which are disposed on opposite sides of the withdrawing line H of the wire W and opposed to each other and are capable of opening and closing, said cutter heads 4 and 5 having insulation cutter blades 4*b*, 5*b* and 4*c*, 5*c* opposed to each other and disposed on opposite sides of wire cutter blades 4*a* and 5*a*. The characters 6, 6′ and 7, 7′ denote tubular wire guides disposed on opposite sides of said wire feed rollers 2 and of the cutter blade assembly 3, respectively, and 8 and 9 denote left and right, wire clamping and insulation stripping clamps each composed of two members and disposed between said wire guides 6' and 7 and on the right side of said wire guide 7', respectively, and adapted to be simultaneously closed in synchronism with the closing action of said cutter blade assembly 3 but adapted to be opened separately, as will be later described in connection with their operation. Further, said clamps are designed so that when said cutter blade assembly 3 is closed, they move away from said cutter blade assembly 3 to strip the portions of the insulation on the wire W between the wire cutter blades 4*a*, 5*a* and the insulation cutter blades 4*b*, 5*b* and 4*c*, 5*c*, the arrangement being such that when the left clamp 8 is moved, said wire feed rollers 2 and wire guides 6, 6' are also moved as a unit.

The right clamp 9 has vertically extending long grooves cut in the opposed surfaces of its clamp members, and wire adhesion preventing bars 10 are fixed in said long grooves in such a manner as to slightly project when said right clamp 9 is in its opened state, so as to wipe the cut wire length W' off the clamp surfaces when the right clamp 9 is opened.

A long-sized wire transfer apparatus according to the present invention to be used with the known roller feed type wire stripper 1 of the construction described above will now be described. The numeral 11 denotes a long-sized wire transfer apparatus affixed to the downstream side of the right clamp 9 of the wire stripper 1 and adapted to be movable by means of ground wheels 13 supported in the lower portion of a mount 12; in use, it is fixed in position with respect to said wire stripper 1 by any suitable fixing device (not shown).

Figure 4:
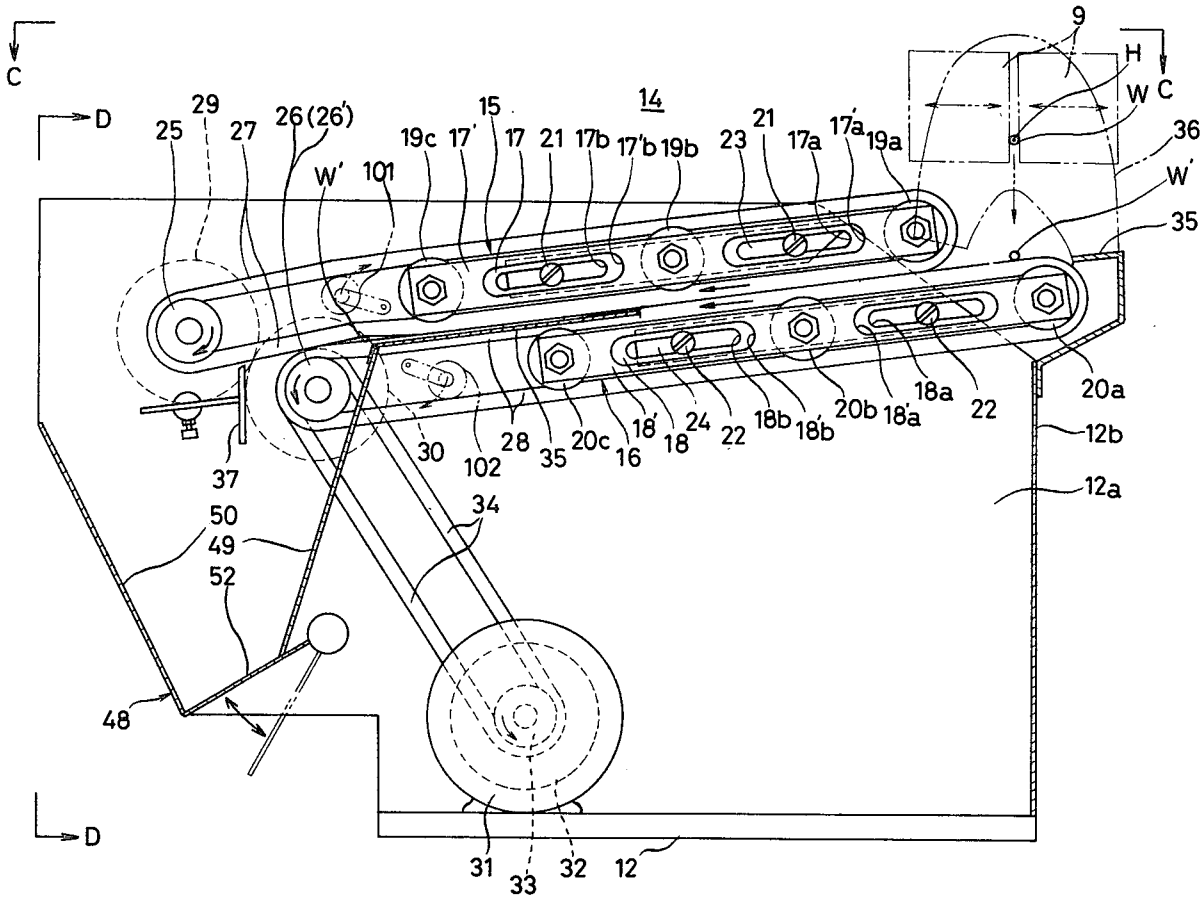
FIG. 4 is an enlarged view of details of a wire clamping transfer conveyor of FIG. 1.
Figure 5:
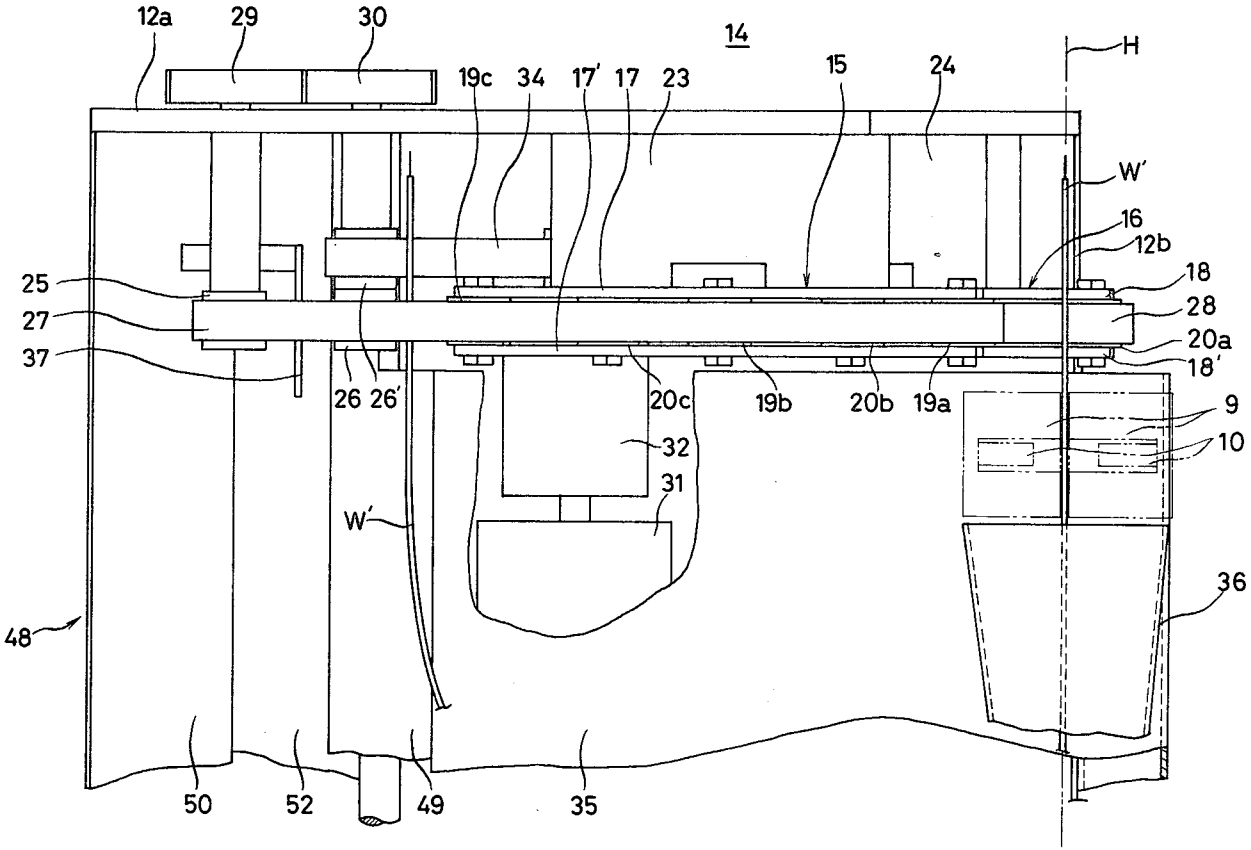
FIG. 5 is a side view taken in the direction of the arrows C—C of FIG. 4.
Figure 6:
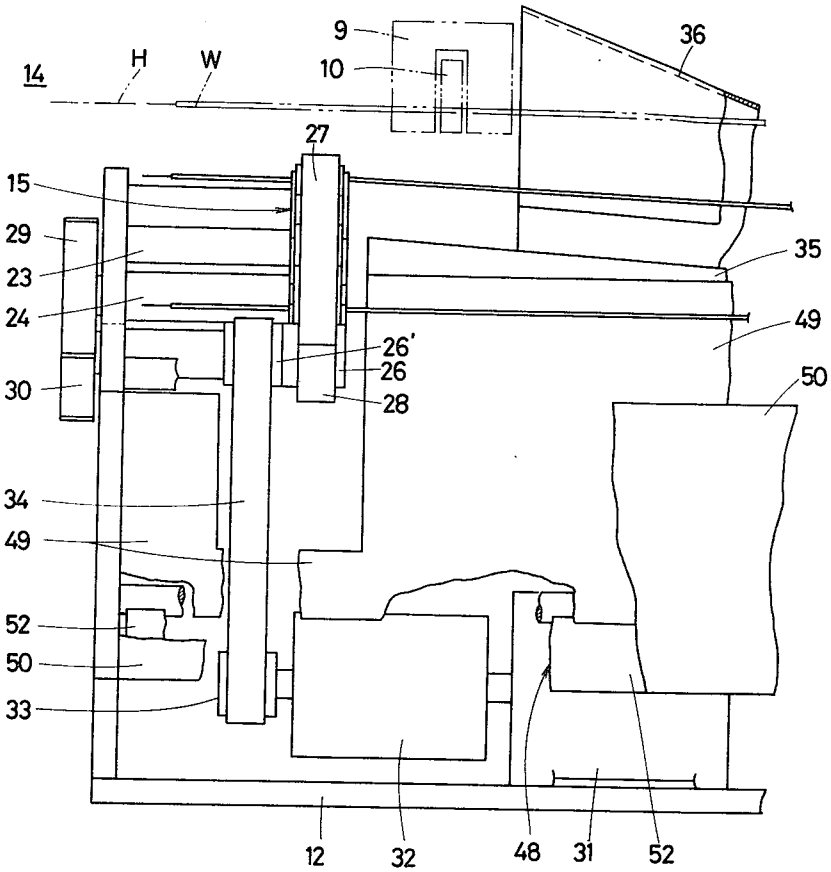
FIG. 6 is a side view taken in the direction of the arrows D—D of FIG. 4.

The numeral 14 denotes a wire clamping transfer conveyor attached to the left side plate 12*a* of said mount 12 and comprising upper and lower pulley assemblies of the same construction. Referring to FIGS. 4 through 6, the upper and lower pulley assemblies 15 and 16 support equispaced pulleys 19*a*, 19*b*, 19*c* and 20*a* 20*b*, 20*c* between opposed support plates 17 and 17' and between 18 and 18', respectively, said support plates 17, 17' and opposed support plates 18, 18' being adjustably fixed to blocks 23 and 24 secured to the left side plate 12*a* by bolts 21, 21 and 22, 22 extending through elongated openings 17*a*, 17'*a* and 17*b*, 17'*b*; 18*a*, 18'*a* and 18*b*, 18'*b* formed therein between the pulleys so that the upper and lower pulley assemblies 15 and 16 extend parallel, one upon the other, and forwardly downwardly, with the lower pulley assembly 16 shifted one-half the pulley-to-pulley distance rearwardly of the upper pulley assembly 15. Thus, disposed between the pulleys 19*a* and 19*b* and between the pulleys 19*b* and 19*c* of the upper pulley assembly 15 are the pulleys 20*b* and 20*c* of the lower pulley assembly 16, respectively, and the pulleys 19*a* and 20*a* are disposed on opposite sides of the withdrawing line H of said wire W. Further, a pulley 25 and a unitary pair of pulleys 26 and 26' are located said pulley-to-pulley distance ahead of said upper and lower pulley assemblies 15 and 16, respectively, and supported on shafts secured to said left side plate 12*a*. Therefore, said pulley 25 is located on-half the pulley-to-pulley distance ahead of said pulleys 26 and 26'. The numerals 27 and 28 denote upper and lower belts extending between said upper pulley assembly 15 and said pulley 25 and between said lower pulley assembly 16 and said pulley 26, respectively. The lower run of the upper belt 27 and the upper run of the lower belt 28 are urged against each other by the zigzag arrangement of said pulleys 20*a*, 19*a*, 20*b*, 19*b*, 20*c*, 19*c*, 26 and 25. The numerals 29 and 30 denote gear wheels fixed on the same shafts as said pulley 25 and said pulleys 26, 26', respectively, on the left side of said left side plate 12*a* and meshing with each other. The numeral 31 denotes a motor installed on said mount 12 for driving said wire clamping transfer conveyor 14, said motor 31 having an output shaft on which a driving pulley 33 is fixed through a clutch 32, with an endless belt 34 entrained between said driving pulley 33 and said pulley 26'. Thus, said wire clamping transfer conveyor 14 intermittently circulatively drives said upper and lower belts 27 and 28 clockwise and counterclockwise, respectively, as viewed in FIG. 4, while retaining said urged state, through the transmission mechanism including the driving pulley 33, the endless belt 34, and the gear wheels 29 and 30, by the suitable engagement and disengagement of the clutch 32 controlled by timers T1 and T2 (FIG. 7) during the continuous operation of the motor 31, as will be later described in more detail in connection with the operation of the apparatus.

The numeral 35 denotes a slide plate fixed to the rear plate 12*b* of the mount 12, forming a forwardly downwardly and rightwardly downwardly inclined gentle slope along the upper run of said lower belt 28 downstream (rightwardly) of said wire claming transfer conveyor 14. The numeral 36 denotes a curved plate attached to the rear upper surface of said slide plate 35 to serve as a guide during the withdrawal of the wire W, said curved plate being opened in the bottom and having a large downstream opening which is gradually decreased toward the downstream (right) side to enclose the withdrawing line H of said wire W, the position of the left end of said curved plate 36 being located slightly rightwardly of the right position to which said right side clamp 9 is moved during its insulation stripping action, as shown in FIGS. 5 and 6.

The numeral 37 denotes a wire stop formed of a square plate attached to said left side plate 12*a* through a suitable bracket at a position located a little ahead of the place where said upper and lower belts 27 and 28 part from each other, the distance from said parting place being suitably adjustable, said wire stop serving to prevent the cut wire length W' from being ejected too long a distance when it is discharged from said belt parting place, so as to guide it straight down.

Referring to FIGS. 1 through 3, the numeral 38 denotes a wire drift conveyor installed downstream of said slide plate 35, comprising a pair of suitably spaced rollers 39 and 40 mounted on said mount 12, an endless belt 41 entrained between said rollers, a clutch 42 and a brake 43 mounted on the same shaft as said right side roller 40, a pulley 44 loosely mounted on said shaft, an endless belt 47 entrained between said pulley 44 and a pulley 46 fixed on the output shaft of a motor 45 installed on the mount 12, the arrangement being such that by the action of the brake 43 and the clutch 42 adapted to be engaged in response to an OFF signal from the timer T1 (FIG. 7) and disengaged in response to a signal indicating the completion of the displacement of the right clamp 9 for insulation stripping, said endless belt 47 is intermittently circulatively driven in the direction of arrow in FIG. 1.

The numeral 48 denotes a wire storing device mounted on the mount 12 by suitable brackets to extend from the lower portion of the terminal end of said wire clamping transfer conveyor 14 along the front of said wire drift conveyor 38. It is composed of a front inclined plate 49 and a rear inclined plate 50 which are downwardly convergent to provide an opening of suitable width at the bottom, said opening being normally closed by a shutter 52 operable by a solenoid 51. When the number of signals when the clutch 32 of said wire clamping transfer conveyor 14 changes over from "ON" to "OFF" reaches (n/x+1) (where n is the number of cut wire length to be stored in the wire storing device 48, and x is the number of wires to be cut at a time), a stepping relay SR (FIG. 7) is energized, whereby the timer T2 (FIG. 7) is actuated and the wire clamping transfer conveyor 14 is driven a little. At the same time as the timer T2 is deenergized, a time T3 (FIG. 7) is energized to energize the solenoid 51 to open the shutter 52. At the end of the timing period set on the timer T3, the timer T3 is deenergized to deeenergize said solenoid 51, thereby closing the shutter 52.

The numeral 53 denotes a wire bunch transfer conveyor adapted to be movable by ground wheels 55 supported on a mount 54. When it is desired to use said conveyor, it is fixed in position by a suitable fixing device (not shown) to extend forwardly from immediately below said wire storing device 48. It is constructed as follows. The wire bunch transfer conveyor 53 has a plurality of wire collecting trays 56 which are equidistantly fixed to an endless chain 57 mounted around a pair of sprockets 58 and 58' supported on the mount 54 through suitable brackets. A motor 59 installed on the mount 54 drives an endless chain 61 entrained between a sprocket on the motor shaft and a sprocket 60 fixed coaxially with said sprocket 58. Thus, each time said shutter opens and closes m times, which is a predetermined number, said wire collecting trays 56 are intermittently circulatively driven through one pitch in the direction of arrow in FIG. 2 through the endless chain 61 by a preset autocounter PC (FIG. 7) to be later described. In addition, the numeral 62 denotes a wire receiving box installed below the terminal transfer end of said wire bunch transfer conveyor 53, said box being provided according to the need.

The preset autocounter PC counts the number of times of opening and closing of the shutter 52 such that each time the timer T3 runs out, "1", as an input signal is added. When the count number reaches the preset number "m", an output signal is issued to drive said motor 59 and instantly the count number is brought back to "0" by a reset circuit (not shown). Thus, the wire collecting trays 56 are moved through one pitch by the driving of said motor 59 and stopped by the action of a suitable limit switch (not shown).

The wire stripper 1 usually cuts a single wire W at a time, but there are other types which cut many wires at a time, such a 2 wires or 3 wires at a time. When it is desired to collect N wire lengths in each of the wire collecting trays 56, let x be the number of wires to be cut at a time, then N=(n/x)m. Suppose that N=60 wire lengths W' are to be collected in each of the wire collecting trays 56 by using a 1-cut (x=1) wire stripper 1. If a stepping relay SR for 11 times is used, then n+1=11 and hence n=10. thus, it is seen that 10 cut wire lengths W' are stored in the wire storing device 48 and that the number of times m of opening and closing of the shutter 52, namely, the number to be set on the preset autocounter PC, should be "6".

Figure 7:
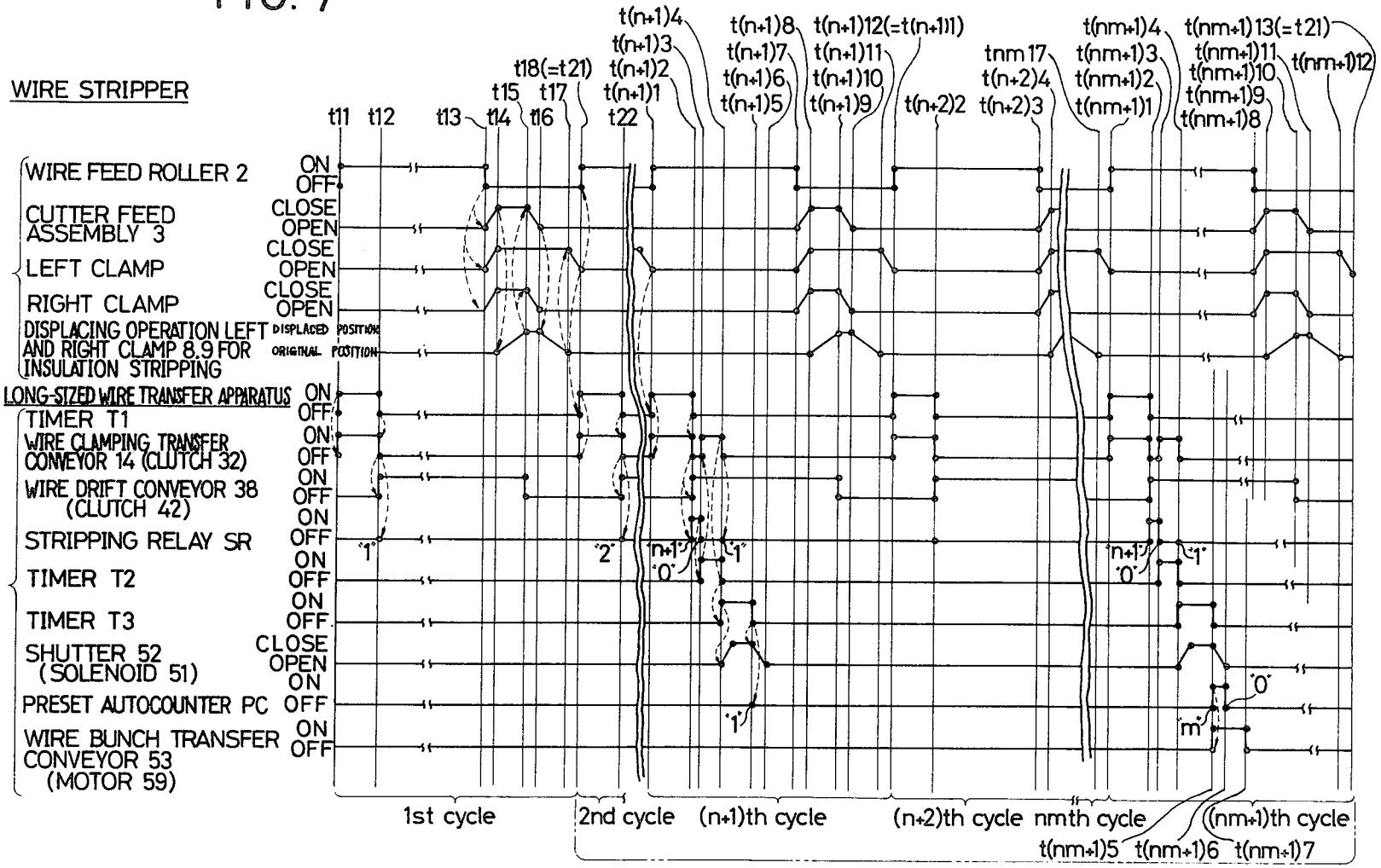
FIG. 7 is a timing chart of the apparatus of FIG. 1.

Referring to FIG. 7, the operation of the apparatus will now be described in connection with a 1-cut (x=1) wire stripper 1.

Suppose that in the wire stripper 1, the left and right clamps 8 and 9 are both opened in their original positions, that the cutter assembly 3 is also in its opened state, and that thw wire feed rollers 2 have stopped driving. Also suppose that in the long-sized wire transfer apparatus 11, with the clutches 32 and 42 disengaged, the wire clamping transfer conveyor 14 and the wire drift conveyor 38 have both stopped traveling and that the wire storing device 48 is empty, with the shutter 52 closed (that is, the solenoid 51 is in the deenergized (OFF) state). Further, suppose that the wire bunch transfer conveyor 53 has stopped driving, with an empty wire collecting tray 56 waiting immediately below said now empty, wire storing device 48.

Time t11→t12 . . . the manipulation of an unillustrated push button drives the wire feed rollers 2, starting to feed the wire W. On the other hand, in operative association with said manipulation of the push button, the timer T1 is actuated to engage the clutch 32, causing the idle running of the wire clamping transfer conveyor 14, with no wire length clamped therein. When said timer T1 runs out, said transfer action is stopped and the clutch 42 is engaged, driving the wire drift conveyor 38 (t12). About the time when said wire drift conveyor 38 starts driving, the downstream front end of the wire W approaches the initial end of the wire drift conveyor 38, passing over the lower belt 28 of the wire clamping transfer conveyor 14 and sliding along the slide plate 35. Thereafter, the wire W is drifted further downstream on the endless belt 41 which is being circulatively driven. Further, in response to a signal produced when the clutch 32 is disengaged, the stepping relay SR advances to a position "1" but is not energized.

Time t13→t14 . . . the wire feed rollers 2 have completed the feeding of a required amount of wire W and stops driving (t13). Subsequently, the cutter blade assembly 3 and the left and right clamps 8 and 9 are closed, so that the wire W is cut to the predetermined length and the insulation cutter blades 4*b*, 5*b*, 4*c* and 5*c* make cuts in the portions of the insulation on the right end of the remaining wire W and on the left end of the cut wire length W' on the opposite sides of the wire cutting position (t14).

Time t14→t15 . . . with the completion of the closing of said cutter blade assembly 3, etc., the left and right clamps 8 and 9, while clamping the remaining wire W and the cut wire length W', respectively, are displaced upstream and downstream, respectively, thereby stripping said cut portion of the insulation (t15). At this time, the right clamp 9 passes over the lower belt 28 of the wire clamping transfer conveyor 14 and stops very close to the curved plate 36. When the displacement of the right clamp 9 is completed, a suitable limit switch (not shown) is actuated to disengage the clutch 42, so that the circulative driving of the endless belt 41 of the wire drift conveyor 38 is stopped.

Time t15→t16 . . . upon completion of the displacement of said left and right clamps 8 and 9, the cutter blade assembly 3 and the right clamp 9 are opened, allowing the left end of the cut wire length W' to fall onto the lower belt 28 of the wire clamping transfer conveyor 14.

Time t16→t17 . . . both the left and right clamps 8 and 9 are returned to their original position.

Time t17→t18 (=t21) . . . the left clamp 8 is opened to release the remaining wire W.

The above operations are the same up to the (n)th cycle, but when the wire clamping transfer conveyor 14 s driven in time t21→t22 in the second cycle, the cut ire length W′ cut in the preceding cycle and having its left end dropped onto the lower belt 28 is transferred to the terminal end of the wire clamping transfer conveyor 14 while being clamped between the upper and lower belts 27 and 28 with its right poriton lying on the endless belt 41 of the wire drift conveyor 38 and once stops there, and the subsequent driving of the wire drift conveyor 38 causes said right portion of the cut wire length W′ to slide down the endless belt 41 into the wire storing device 48. Then, the wire clamping transfer conveyor 14 is driven in time t31→t32 (not shown) in the third cycle, whereby the left end portion of the cut wire length W′ is released from between the upper and lower belts 27 and 28 and drops into the wire storing device 48. At this time, of course, the left end of the next cut wire length W′ has been clamped by the wire clamping transfer conveyor 14 adjacent its terminal end. When the (n+1)th cycle is reached, the opening and closing operation of the shutter 52 is carried out as follows, but the operation of the wire stripper 1 is the same in all cycles.

Time t(n+1)1→t(n+1)2 . . . the wire feed rollers 2 are driven to feed the wire W. Concurrently therewith, the wire clamping transfer conveyor 14 is driven under the control of the timer T1, so that the (n−1)th cut wire length W′ drops off the terminal end of the transfer conveyor 14 into the wire storing device 48 while the (n)th cut wire length W′ is transferred to said terminal end, where it is held clamped.

Time t(n+1)2→t(n+1)3 . . . upon deenergization of the clutch 32 for said wire clamping transfer conveyor 14, the clutch 42 is engaged to drive the wire drift conveyor 38, so that only the right portion of said (n)th cut wire length W′ slides forwardly on the endless belt 41 to drop into the wire storing device 48. On the other hand, the right portion of the wire W which will become the (n+1)th cut wire length W′ is approaching the left end of the endless belt 41. In response to a signal produced upon disengagement of the clutch 32, the stepping relay SR advances from "n" to "n+1" and is energized, whereupon it returns to the "0" position.

Time t(n+1)3→t(n+1)4 . . . in response to a signal indicating the return of the stepping relay SR to the "0" position, the timer T2 is actuated to engage the clutch 32 again to cause the wire clamping transfer conveyor 14 to move a little and then stop, so that the left end portion of the (n)th cut wire length W′ is also released to drop into the wire storing device 48. This means that the (n)th cut wire length W′ has been accommodated in the wire storing device 48. In response to a signal produced when said clutch 32 is disengaged again, the stepping relay SR advances from the "0" position to the "1" position. Further, in response to a signal produced when said timer T2 has run out, the timer t3 is turned on.

Time t(n+1)4→t(n+1)5 . . . the actuation of said timer T3 causes the energization of the solenoid 51 which opens the shutter 52, so that the n cut wire lengths stored in the wire storing device 48 drop into the wire collecting tray 56, which is empty. When the timer T3 runs out, the solenoid 51 is also deenergized to allow the shutter 52 to close (t(n+1)6), and in response to a signal indicating the run-out of the timer T3, the preset autocounter PC counts "1". The subsequent timer t(n+1)7 to t(n+1)12 (=t(n+1)1) are exactly the same as the times t11 to t18 (=t21) described above.

In this way, each time n cut wire lengths W′ are stored in the wire storing device 48, the shutter 52 is opened to allow the bunch of said cut wire lengths W′ to drop into the wire collecting tray 56. Now, suppose that the shutter 52 has already completed (m−1) opening and closing operations, that (n−2) cut wire lengths W′ have newly been stored in the wire storing device 48, that the (n−1) th cut wire length W′ has its right portion alone dropped into the wire storing device 48, with its left portion still held by the terminal end of the wire clamping transfer conveyor 14, and that the (n)th cut wire length W′ has its left end lying on the lower belt 28 of the wire clamping transfer conveyor 14 and its intermediate and right portions lying on the slide plate 35 and endless belt 41, respectively. A description will now be given of the (nm+1)th cycle in which the wire bunch transfer conveyor 53 is first driven through one pitch.

In times t(nm+1) to t(nm+1)5, in exactly the same manner as in the times t(n+1)1 to t(n+1)5 described above, the (n−1)th and (n)th cut wire lengths W′ are completely dropped into the wire storing device 48 and subsequently the opening and closing operation of the shutter 52 allows the n cut wire lengths W′ to drop into the wire collecting tray 56, so that a total of nm cut wire lengths W′ are collected in said wire collecting tray 56.

Time t(nm+1)5→t(nm+1)7 . . . in response to a signal produced upon deenergization of the timer T3 in time t(nm+1)5, the preset autocounter PC counts "m", giving a drive instruction signal to the motor 59, so that the wire bunch transfer conveyor 53 drives the wire collecting trays 56 through one pitch, whereupon the action of a suitable limit switch stops said conveyor 53 (t(nm+1)7), with a new empty wire collecting tray 56 disposed immediately below the wire storing device 48. Further, said preset autocounter PC, after issuing said signal is reset and counts "0" (t(nm+1)6).

The subsequent times t(nm+1)8 to t(nm+1)13 are exactly the same as the previously described times t11 to t18 (=t21) and the times t(n+2)7 to t(n+1)12 (=t(n+2)1).

If the operation is to be further continued, the time t(nm+1)13 at the end of the (nm+1)th cycle returns to the time t21. During the intervening cycles, the desired N (=nm) cut wire lengths W′ are successively collected in the wire collecting tray 56 and transferred, said cut wire lengths W′ being picked up by the operator with sufficient time for typing or other operation.

The embodiment described above is effective when the cut wire length W′ is long enough to reach the wire drift conveyor 38. If it does not reach the conveyor 38, the motor 45 of the wire drift conveyor 38 is not driven and the wire clamping conveyor 14 is constantly driven with the clutch 32 kept engaged, so that as soon as the cut wire length W′ treated in the wire stripper 1 drops onto the lower belt 28, it is forwardly transferred without interruption until it is discharged into the wire storing device 48. In this case, the stepping instruction signal for the stepping relay SR is derived from the signal which is produced when the wire feed rollers 2 changes over form "OFF" to "ON". When the stepping relay SR reaches the "n+1" position, it is energized to actuate a delay timer (not shown) adapted to energize the solenoid 51 to open the shutter 52 at about the time when the (n)th cut wire length W′ has dropped into the wire storing device 48, said shutter being closed before the (n+1)th cut wire W′ drops into the wire storing device 48.

As another embodiment of the invention, said wire bunch transfer conveyor 53 may be replaced by a fixed type wire collecting tray 100 installed immediately below the wire storing device 48, as shown in dot-dash lines in FIG. 2. In this case, each time N cut wire lengths W' are stored in the wire storing device 48, the shutter 52 is opened to discharge them into the wire collecting tray 100. Then the operator has to take these cut wire lengths out of the wire collecting tray 100 before the shutter 52 opens again. If N is small, the operator will be restricted by time.

Figure 9:
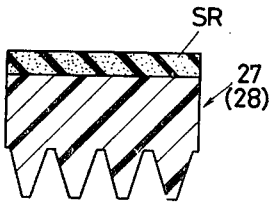
FIG. 9 is a transverse sectional view of an endless belt with sponge rubber.
Figure 10:
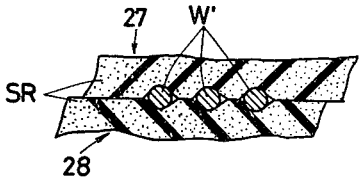
FIG. 10 is a side view, showing an upper and lower belt of the wire clamping transfer conveyor, each having sponge rubber, clamping a plurality of cut wire length.

In addition, if the wire collecting apparatus of the present invention is applied to a wire stripper which cuts three or more wires at a time, it sometimes occurs that when the wire clamping conveyor 14 is once stopped with cut wire lengths clamped at the terminal end of said conveyor, the upper and lower belts 27 and 28 become somewhat slack, so that cut wire lengths W' disposed intermediately on the conveyor are not firmly clamped but float. If the wire drift conveyor 38 is driven under these conditions, said cut wire lengths W' not firmly clamped would be drifted. As a preventive measure, tension rollers 101 and 102 may be provided with respect to the upper and lower belts 27 and 28, respectively, as shown in double-dot-and-dash lines in FIG. 4, the arrangement being such that at the same time as the wire clamping transfer conveyor 14 is stopped, the tension rollers 101 and 102 are respectively upwardly and downwardly urged to stretch the upper and lower belts 27 and 28, so as to firmly clamp all the cut wire lengths W'. Alternatively, as shown in FIGS. 9 and 10, the upper and lower belts may each have a soft material such as sponge rubber SR of suitable thickness applied to the surface thereof, whereby the floating of said cut wire lengths W' can be prevented.

Figure 8:
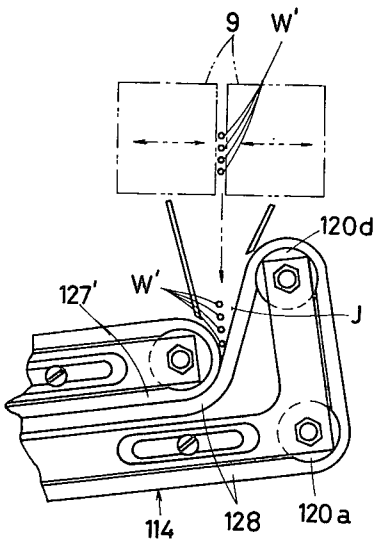
FIG. 8 is a detail view of the initial end of the wire clamping transfer conveyor, showing a modified embodiment.

Further, if a plurality of cut wire lengths W' are dropped, in a vertically aligned state, onto the lower belt 27 which is substantially horizontal, they sometimes overlap each other. If the cut wire lengths W' are transferred in this state, there would be disadvantages including the cut wire lengths W' getting into a habit of bending. These disadvantages can be eliminated by modifying the initial end portion of the wire clamping transfer conveyor 14 in the manner shown in FIG. 8.

Thus, in a wire clamping transfer conveyor 114, a pulley 120*d* is newly provided over the upstream end pulley 120*a* to provide a V-shaped meeting region J where the upper and lower belts 127 and 128 meet together. If a plurality of cut wire lengths W' are dropped into said V-shaped meeting region J during the circulative driving of the upper and lower belts 127 and 128, they will be sucked one by one between the upper and lower belts 127 and 128 without overlapping each other and transferred as clamped.

Figure 11:
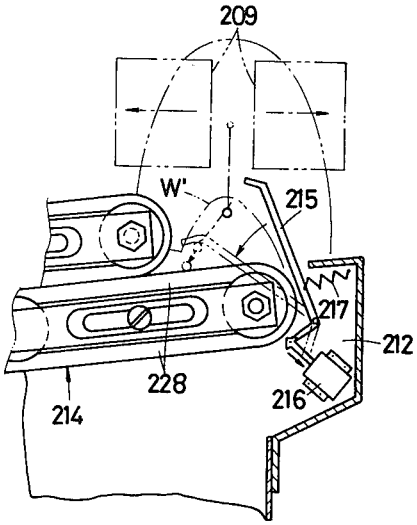
FIG. 11 is a detailed view of the wire clamping transfer conveyor, showing another modified embodiment, which has a wire knock-down bar at its initial end.

Further, as shown in FIG. 11, a wire knock-down bar 215 may be provided at the initial end of the wire clamping transfer conveyor 214, whereby cut wire lengths W', even if having a strong habit of bending, can be securely clamped and transferred.

More particularly, the wire knock-down bar 215 is pivotally supported on a suitable portion of a mount 212 so that with a fulcrum at its lower bend it can be swung in a vertical plane parallel to the direction of transfer, the upper end of said wire knock-down bar being somewhat curved toward the downstream side of the conveyor and extended to the height of the right clamp 209, the lower end being pivotally connected to the front end of the rod of a solenoid 216. Normally, the wire knock-down bar 215 is maintained in its upper position shown in solid lines by a tension spring 217 stretched between the longer side of said bar and a sutiable portion of the mount 212. The arrangement is such that some little time after the opening of the right clamp 209 (that is, after the completion of the opening of the cutter blade assembly), said solenoid 216 is actuated to swing the wire knock-down bar to its lower position shown in double-dot-and-dash lines, knocking down a cut wire length W' onto the lower endless belt 228, thereby making firm the contact of rear end portion of said wire length with the belt surface.

Figure 13:
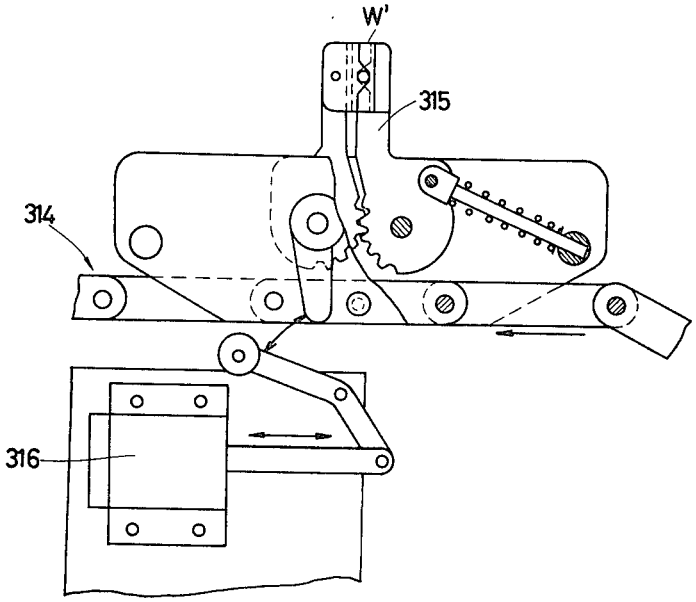
FIG. 13 is an enlarged view of details of the portion E shown in FIG. 12.
Figure 12:
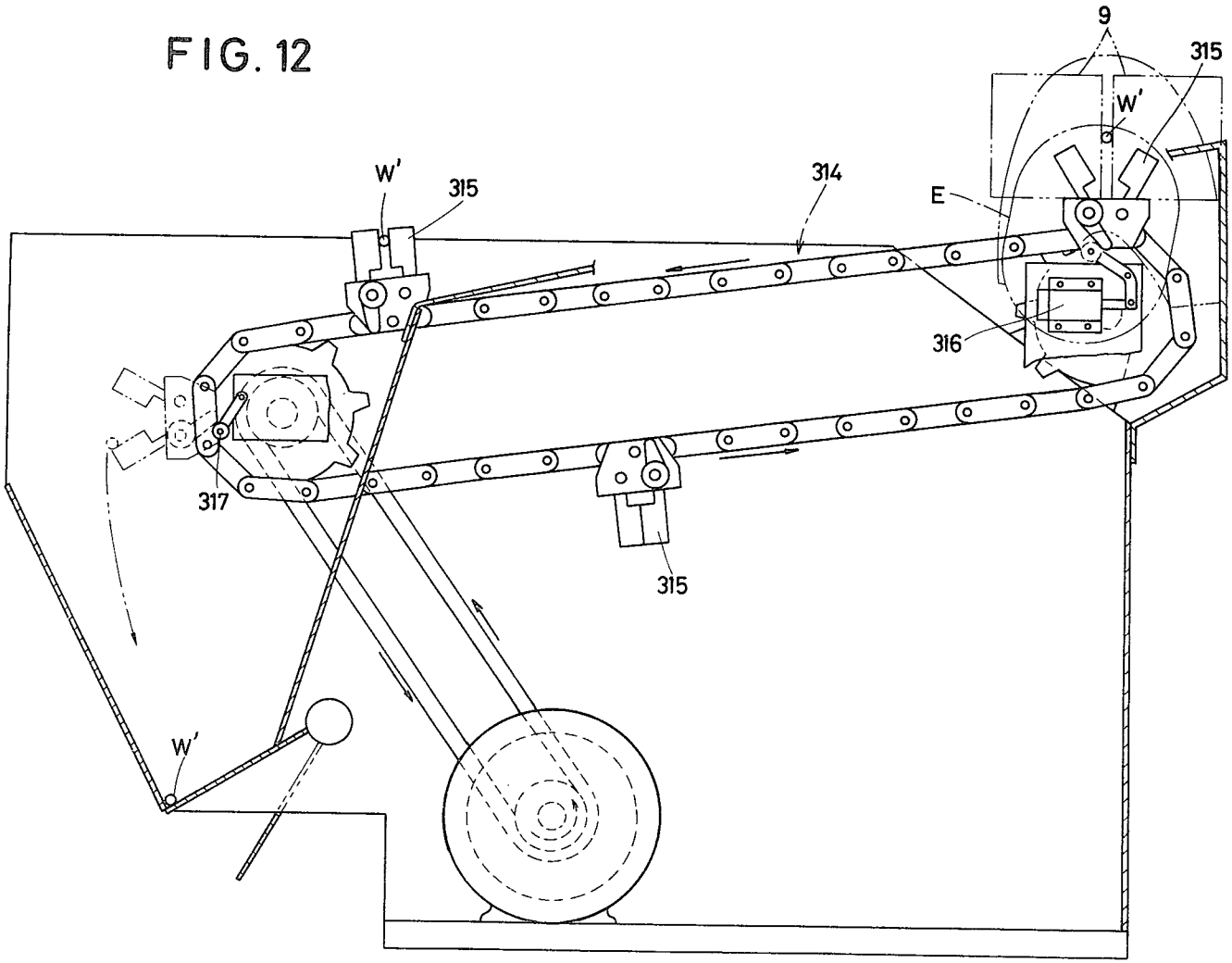
FIG. 12 shows a further modified embodiment of the wire clamping transfer conveyor comprising an endless chain and wire clamping pawl units.

Further, the invention may be embodied as shown in FIGS. 12 and 13, wherein a wire clamping transfer conveyor 314 has three wire clamping pawl units 315 equidistantly fixed thereto, said conveyor being intermittently driven through one pitch each time. Each of said wire clamping pawl units 315 is maintained normally closed by a spring, and at the initial end of the conveyor, it is at rest immediately below the wire withdrawing line and clamp the cut wire length W' under the action of a solenoid 316. When it is moved to the lower region of the rear end by the movement of the conveyor it is opened by engagement with a suitable roller 317 to release the cut wire length W'.

Further, while the shutter 52 has been described as being normally closed and being opened each time a predetermined number of cut wire lengths have been stored in the wire storing device 48, the shutter 52 may be maintained normally opened if the bottom opening in the wire storing device 48 is sufficiently enlarged and the distance between the bottom opening and the wire collecting tray 56 and 100 is shortened to such a degree as not to interfere with the opening and closing operation of the shutter 52. Thus, each time a desired number of cut wire lengths W' are stored in the wire collecting tray 56 or 100, the shutter 52 is closed until the wire collecting trays 56 are moved through one pitch to bring a new empty wire collecting tray 56 immediately below said bottom opening or until the cut wire lengths W' in the wire collecting tray 100 are taken out, whereupon the shutter is opened again.

As has been described so far, according to the apparatus of the invention, since a wire, however long, which is withdrawn by the wire feed rollers or the clamp device rides on he endless belt of the wire drift conveyor and is forcibly drifted,there is no disadvantage of the wire being bent to be prevented from traveling.

Further, if the pair of upper and lower endless belts have their pulley arranged in zigzags to press cooperating endless belt, wires can be firmly held with a sufficient clamping force even if the wires have more or less different diameters. Further the wire clamping transfer conveyor can be arranged to be once stopped while holding the rear end of the cut wire length adjacent the terminal end while the wire drift conveyor is driven to drop the front end portion of said cut wire length into the wire storing device, whereupon said rear end portion is released. As a result, long-sized cut wire lengths can be collected in the wire storing device or wire collecting tray in a state where the wire length is substantially straight and its opposite ends are aligned. Moreover, a predetermined number of cut wire lengths are automatically collected. Besides this, the provision of the wire bunch transfer conveyor which transfers a plurality of wire collecting trays makes it easy to take out the cut wire lengths in groups each containing a predetermined number, and provides an increased margin of time, greatly lessening the operator's fatigue.

Further, if the wire clamping transfer conveyor, wire drift conveyor and wire storing device are constructed as a movable unit and since the wire bunch transfer conveyor is also made movable, they can be easily affixed to any existing wire cutting machine or the like and they can be easily detached therefrom for cleaning, repair or insepction.

Although the present invention has been described and illustrated in detail, it is clearly understood that the same is by way of illustration and example only and is not to be taken by way of limitaion, the spirit and scope of the present invention being limited only by the terms of the appended claims.

What is claimed is:

1. A long-sized wire tranfer apparatus, comprising:

a wire clamping transfer conveyor for clamping the vicinity of the terminal end of a cut wire length as cut into a predetermined length and withdrawn in the length direction thereof and for transferring said cut wire length in the direction at the right angle with respect to the wire withdrawing line and substantially in a lateral direction, a wire drift conveyor arranged to extend along said wire withdrawing line with a predetermined width in the cut wire length withdrawing direction of said wire clamping transfer conveyor with the terminal end of a transfer path of said wire clamping transfer conveyor left, and having a transferring surface which is substantially horizontal and moves in said cut wire length withdrawing direction, and wire collecting means disposed at the downstream side of said terminal end of said transfer path of said wire clamping transfer conveyor and adjacent said wire drift conveyor.

2. A long-sized wire transfer apparatus in accordance with claim 1, wherein said wire clamping transfer conveyor comprises a pair of upper and lower endless belts.

3. A long-sized wire transfer apparatus in accordance with claim 2, wherein said upper endless belt is provided at the initial end of said wire clamping transfer conveyor as relatively displaced to the downstream side of said wire clamping transfer conveyor with respect to the lower endless belt of said lower belt endless.

4. A long-sized wire transfer apparatus in accordance with claim 3, wherein said wire clamping transfer conveyor comprises two belt tension retaining pulleys disposed at both ends of said transfer path of said wire clamping transfer conveyor for tensioning said endless belts, and at least one intermediate pulley disposed intermediate said two belt tension retaining pulleys, and said belt tension retaining pulley and said intermediate pulley associated with said one endless belt and said belt tension retaining pulley and said intermediate pulley disposed associated with said other endless belt are arranged in a zigzag fashion.

5. A long-sized wire transfer apparatus in accordance with claim 3, wherein said upper endless belt and said lower endless belt cooperatively form a V-letter shaped opening opened upward at said initial end of said wire clamping transfer conveyor.

6. A long-sized wire transfer apparatus in accordance with claim 2, wherein said upper and lower endless belts are adapted such that the surfaces thereof in contact with each other are soft.

7. A long-sized wired transfer apparatus in accordance with claim 6, wherein said upper and lower endless belts each comprise a sponge rubber layer applied to the surfaces in contact with each other.

8. A long-sized wire transfer apparatus in accordance with claim 1, which further comprises a slide plate disposed between said wire clamping transfer conveyor and said wire drift conveyor.

9. A long-sized wire transfer apparatus in accordance with claim 1, which is combined with a wire cutting machine comprising a wire feed mechanism for intermittently feeding a wire, and a cutter blade assembly which opens and closes to cut into predetermined lengths a wire intermittently fed in by said wire feed mechanism, whereby said cut wire lengths are withdrawn from said wire cutting machine.

10. A long-sized wire transfer apparatus in accordance with claim 9, wherein said wire clamping transfer conveyor is driven intermittently through one-pitch during each drive of said wire feed mechanism, whereby a cut wire length clamped at the initial end of said wire clamping transfer conveyor is transferred by one-pitch drive toward their terminal end where said cut wire length is still held clamped, said still held clamped cut wire length being released from the terminal end by the next one-pitch drive.

11. A long-sized wire transfer apparatus in accordance with claim 9, wherein said wire drift conveyor starts its drive somewhat later than the start of the wire feed action of said wire feed mechanism and stops its drive after the completion of the closing action of said cutter blade assembly.

12. A long-sized wire transfer apparatus in accordance with claim 9, which further comprises a wire knock-down bar displaceable upward and downward at the initial end position of said wire clamping transfer conveyor for knocking down said cut wire length at the initial end of said wire clamping transfer conveyor, said wire knock-down bar being adapted to be displaced downward somewhat later than the completion of the opening action of said cutter blade assembly, thereby to knock down said cut wire length.

13. A long-sized wire transfer apparatus in accordance with claim 12, wherein said wire knock-down bar is turnably provided.

14. A long-sized wire transfer apparatus in accordance with claim 13, which further comprises a spring for urging said wire knock-down bar toward an upwardly turned position, and a solenoid for turning downward said wire knock-down bar against said spring.

15. A long-sized wire transfer apparatus in accordance with claim 9, wherein said wire clamping transfer conveyor comprises an endless chain, and a plurality of openable/closable wire clamping pawl units equidistantly attached to said endless chain, said endless chain being intermittently driven through one-pitch of said wire clamping pawl units during each drive of said wire feed mechanism, each of said wire clamping pawl units clamping a cut wire length by its closing action at the initial end of said wire clamping transfer conveyor with the pawls at rest immediately below the wire withdrawing line, said one-pitch drive transferring said cut wire length toward the terminal end of said wire clamping transfer conveyor where it is still held clamped, the next one-pitch drive resulting in the clamping pawls being opened at the terminal end ot release the cut wire length.

16. A long-sized wire transfer apparatus in accordance with claim 1, wherein said wire collecting means comprises a wire storing device extending from immediately below said wire clamping transfer conveyor along said wire drift conveyor and being adapted to have its bottom opened and closed, and at least one wire collecting tray disposed to receive the cut wire lengths from said wire storing device.

17. A long-sized wire transfer apparatus in accordance with claim 16, wherein said bottom of said wire storing device is opened responsive to receipt of a predetermined number (n) of said cut wire lengths.

18. A long-sized wire transfer apparatus in accordance with claim 17, which further comprises a wire bunch transfer conveyor for achieving a conveying direction in a direction at the right angle with respect to said wire withdrawing line, said wire collecting tray being mounted on said wire bunch transfer conveyor.

19. A long-sized wire transfer apparatus in accordance with claim 18, wherein a plurality of said wire collecting trays are provided equidistantly on said wire bunch transfer conveyor, said wire bunch transfer conveyor being intermittently driven by one pitch responsive to receipt of a predetermined number (n) of cut wire lengths by one said wire collecting tray.

20. A long-sized wire transfer apparatus in accordance with claim 10, wherein said wire clamping transfer conveyor is driven simultaneously with the start of the wire feed action of said wire feed mechanism and in the transfer of the (n)th cut wire length said wire clamping transfer conveyor is driven slightly later than the start of the drive of said wire drift conveyor.

21. A long-sized wire transfer apparatus in accordance with claim 1, wherein said wire drift conveyor comprises an endless belt.

* * * * *